United States Patent [19]

Constantin

[11] Patent Number: 4,754,946

[45] **Date of Patent: * Jul. 5, 1988**

[54] WHEELCHAIR RESTRAINING DEVICE

[76] Inventor: Bruce J. Constantin, 7575 E. Industrial, Baton Rouge, La. 70805

[ * ] Notice: The portion of the term of this patent subsequent to Sep. 1, 2004 has been disclaimed.

[21] Appl. No.: 57,104

[22] Filed: Jun. 3, 1987

Related U.S. Application Data

[63] Continuation-in-part of Ser. No. 851,972, Apr. 14, 1986, Pat. No. 4,690,364.

[51] Int. Cl.[4] ..... A47B 97/00

[52] U.S. Cl. ..... 248/503.1; 280/289 WC; 296/65 R

[58] Field of Search ..... 248/503.1, 503; 280/242 WC, 289 WC, 179 R; 410/4, 7, 23, 57; 297/DIG. 4; 180/326, 330; 296/63, 65 R

[56] References Cited

U.S. PATENT DOCUMENTS

| | | | |
|---|---|---|---|
| 4,389,056 | 6/1983 | Tenniswood | 296/65 R X |
| 4,623,289 | 11/1986 | Apostolos | 296/65 R |
| 4,671,713 | 6/1987 | Lenkman | 410/7 |

*Primary Examiner*—J. Franklin Foss

*Attorney, Agent, or Firm*—William David Kiesel; Robert C. Tucker; Timothy J. Monahan

[57] ABSTRACT

An apparatus for anchoring a wheelchair to the floor of a vehicle while allowing 360° manual rotation of the wheelchair comprising a support bracket connected to the underside of a wheelchair, a vertical shaft extending downward from the bracket and a single locking assembly, connected to the floor of the vehicle, positioned to engage the vertical shaft.

7 Claims, 2 Drawing Sheets

WHEELCHAIR RESTRAINING DEVICE

RELATED APPLICATIONS

This is a continuation in part of U.S. Pat. application Ser. No. 06/851,972 filed by the inventor herein on Apr. 14, 1986 now patent No. 4,690,364, and entitled "Wheelchair Restraining Device", specific mention herein being made to obtain the benefit of its filing date.

FIELD OF THE INVENTION

This invention relates generally to apparatus for anchoring a wheelchair to the floor of a vehicle and more specifically to a single locking assembly which allows the wheelchair to rotate.

PRIOR ART

There has been an increased effort to provide transportation to persons confined to a wheelchair. With most vehicles, a method to safely anchor a wheelchair is required. Important considerations in designing apparatus to secure wheelchairs within a vehicle are reliability, ability to withstand collisions and convenience of operation.

Many prior art methods use a combination of cooperating hooks and latches to secure a wheelchair at several points. While apparatus with multiple latching points have been successful in securing a wheelchair, they often require precise alignment of the wheelchair and manual dexterity on the part of the operator. Additionally, multiple latching points prevent pivoting or rotation of a wheelchair thereby limiting a passenger's ability to change viewpoints.

Prior attempts at securing a wheelchair at a single point have not successfully addressed the design considerations mentioned above. For example the device described in the French patent No. 2480-207 does not appear to be convenient to operate, especially not by the person in the wheelchair. Additionally, the distance from the cross member to the tapering guide would result in excessive torque upon the cross member in a collision. Furthermore, none of the prior art single point securing means are capable of providing wheelchair rotation.

SUMMARY OF THE INVENTION

Therefore it is an object of this invention to provide a wheelchair anchoring apparatus which is convenient to use by the wheelchair occupant.

Another object of this invention is to provide a single point anchoring apparatus which exceeds industry standards for impact protection.

Another object of this invention is to provide a wheelchair anchoring apparatus which allows the wheelchair to roll over curbs without hanging up.

Still another object of this invention is to provide a wheelchair anchoring apparatus which permits manual 360° rotation of the wheelchair.

These and other objects and advantages of the invention shall become apparent from the ensuing description of the invention.

Accordingly, an apparatus for anchoring a wheelchair to the floor of a vehicle is provided comprising a support bracket rigidly connected to the underside of a wheelchair, a vertical shaft, rigidly connected at one end to the support bracket and extending downward while allowing a clearance between an opposite end and the floor, and a single locking assembly comprising a housing connected to the floor and a single locking means, positioned to engage the shaft, for anchoring the shaft and allowing the shaft to rotate relative to the locking means.

PREFERRED EMBODIMENTS OF THE INVENTION

Figure 1:
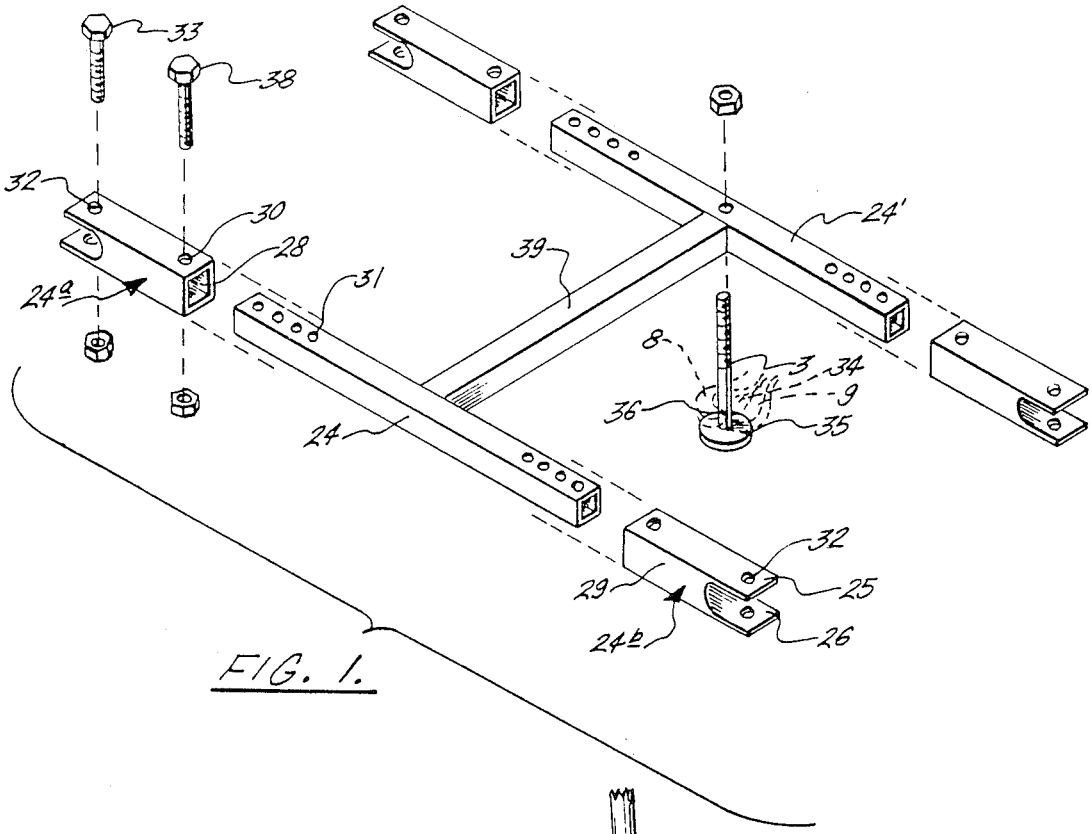
FIG. 1 is a three dimensional view of a "H" shaped support bracket and vertical shaft.

In its broadest sense, this invention comprises a vehicle floor mounted locking assembly 1 for receiving and securing in position a vertical shaft 3 extending from support bracket 2, fixedly attached to wheelchair 4.

Referring now to the figures, the locking assembly 1 preferably comprises a housing 5 in which a conventional vehicle door lock 6 is attached to upper plate 7 in a position that locking members 8 and 9, when in locking position, surround vertical shaft 3 and extend across guide channel 10 formed by vertical channel plate 11 having tines member 12 and 13 extending outward to receive vertical shaft 3 as explained below. In a preferred embodiment, tines 12 and 13 are curved outward at their protruding ends 14 and 15, respectively. In another preferred embodiment, locking members 8 and 9 are provided with conventional double lock protection by means of a two-stage, entry lock and a two-stage lock release for increased safety.

Figure 2:
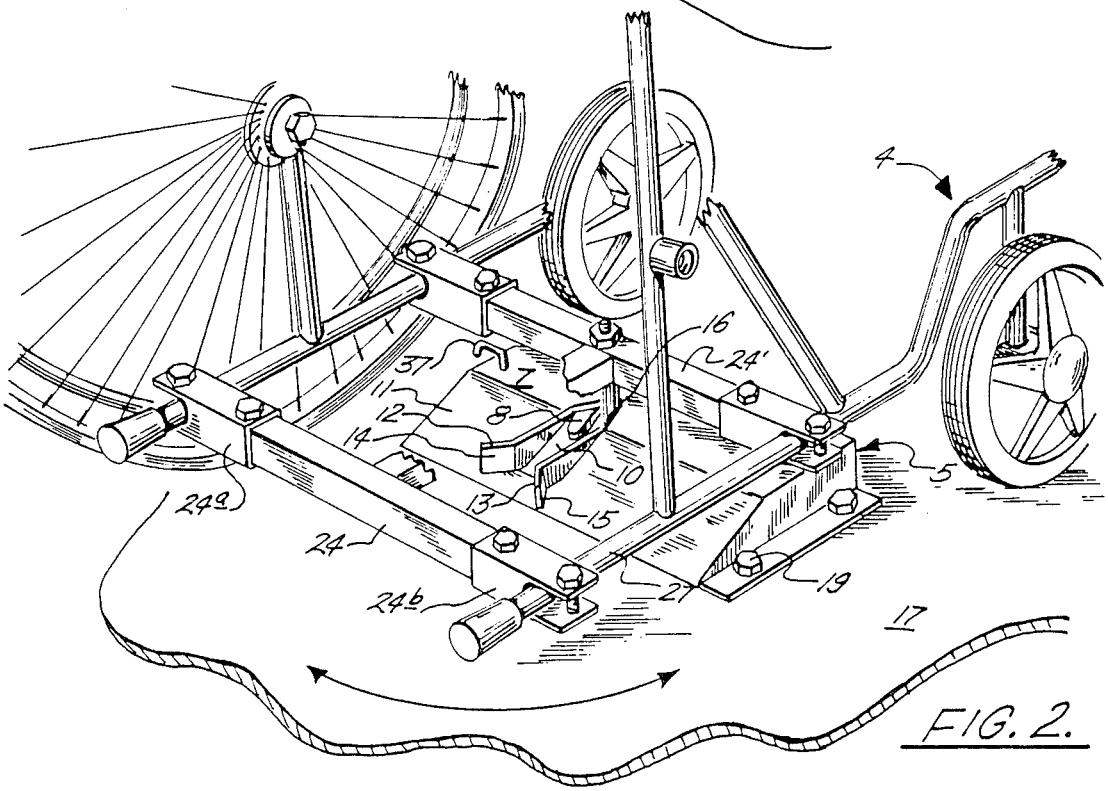
FIG. 2 is a close-up three dimensional view of the wheelchair anchoring apparatus.
Figure 3:
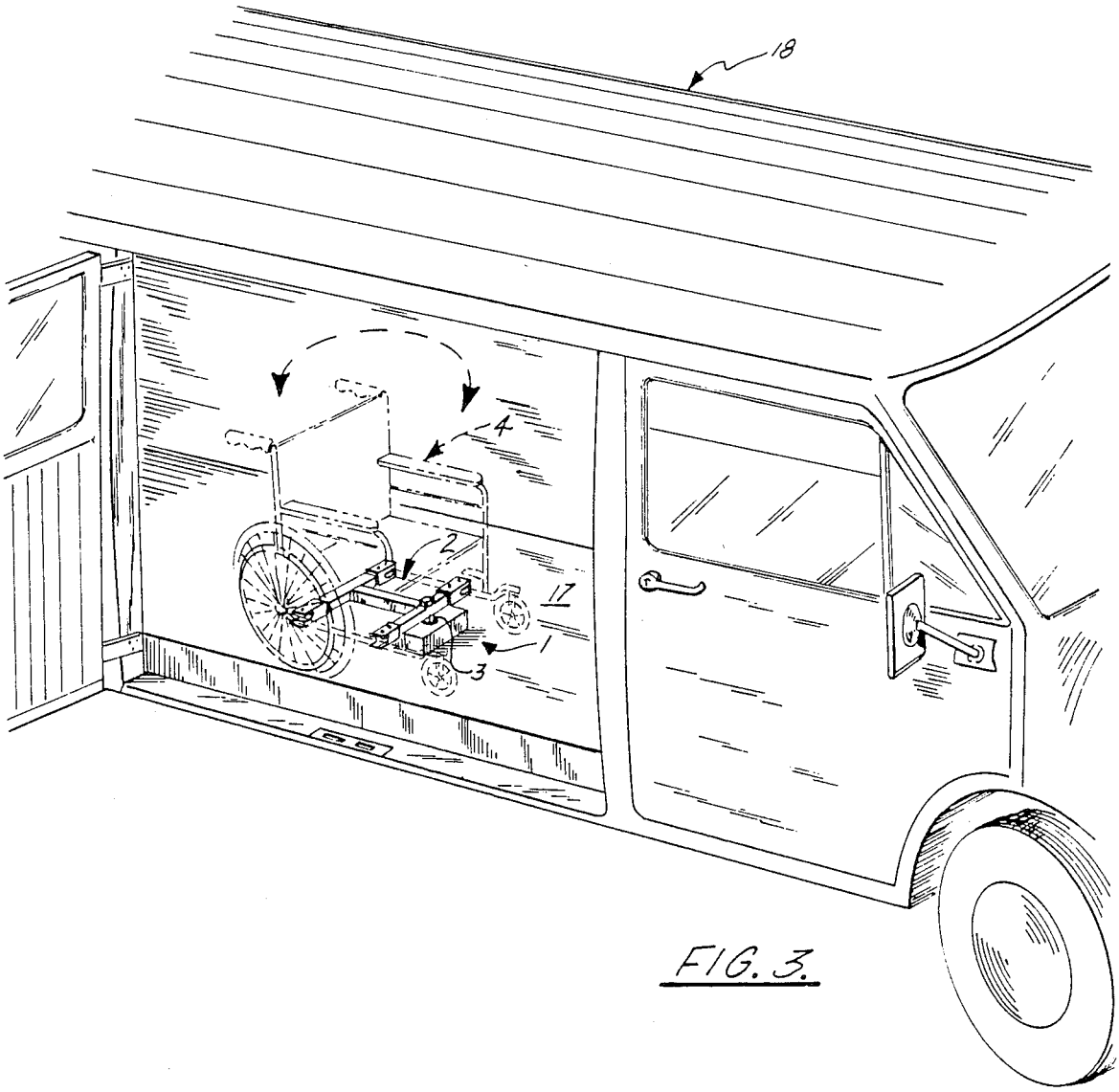
FIG. 3 is a three dimensional view and application of the apparatus in a vehicle.
Figure 4:
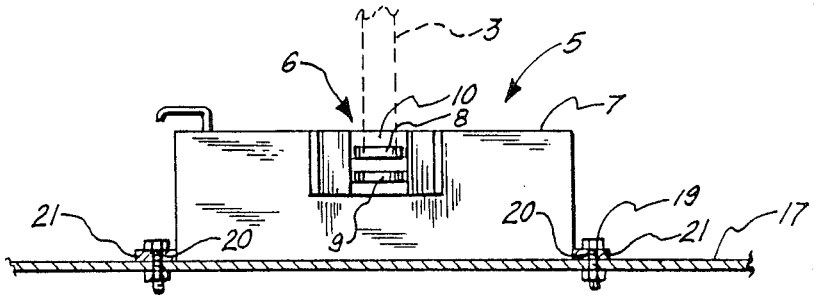
FIG. 4 is a cross-sectional view of the locking assembly.

Housing 5 is mounted to the floor 17 of vehicle 18 by bolts 19 that extend through vehicle floor openings and align with bolt openings 20 in lip plate 21 that extends perpendicularly from the perimeter of housing side plate 22. Housing 5 need not be constructed of solid plates as shown in FIG. 2. A frame structure could also be used to support lock 6 and is meant to be included in the term housing.

Support bracket 2 comprises bar 24 having end section 24A and 24B with spread apart end members 25 and 26 at each end that extend over and under wheelchair runners 27. In a more preferred embodiment, end section 24A and 24B comprise a hollow tube 28 whose inner channel 29 is matingly slidable over bar 24 in order to allow easier attachment to runners 27. Tube 28 is provided with pin openings 30 positioned in alignment on opposite side of tube 28 which can be aligned with one of a series of openings 31 on bar 24 to allow bolts 38 to pass through. In addition, tube 28 has a second pair of aligned openings 32 in each end members 25 and 26 through which bolts 33 can pass to fixedly attach bar 24 to runners 27. In a preferred embodiment, end members 25 and 26 are crimped about runners 27 to permanently attach bar 24 to wheelchair 4. In a more preferred embodiment, a second bar 24' parallel to bar 24 is fixedly attached by cross bar 39 as shown and attaches to runners 27 in similar fashion as bar 24. In this embodiment, additional strength and reduction of damage to the wheelchair and the locking assembly is accomplished.

Vertical shaft 3 is bolted as shown or tac welded or otherwise fixedly attached to bar 24' after proper adjustment so as to extend perpendicularly downward while still allowing operating clearance with the floor. In a preferred embodiment, vertical shaft 3 will have a circular cross-section slightly smaller than opening 34 formed when locking members 8 and 9 are in a locked position to allow wheelchair 4 to pivot about the vertical shaft axis. In a more preferred embodiment, vertical shaft 3 has a flange 35 at its lower end 36 so that flange 35 is positioned below locking members 8 and 9 when vertical shaft 3 is positioned in lock position in opening 34. This prevents the wheelchair 4 from being able to elevate, tilt or move in a vertical direction should the vehicle hit a bump or become involved in an accident.

Support bracket 2 is designed so that vertical shaft 3 will be interiorly positioned with respect to the wheels of wheelchair 4. This optimizes the stability of wheelchair 4 in all directions. Additionally, stability is increased by elevating lock 6 and engaging vertical shaft 3 at a point close to support bracket 2. This works to minimize torque on support bracket 2 in a collision. Vertical shaft 3 is positioned closer to the rear wheels than the front wheels as calculated from the part of the wheels touching the ground. This provides additional stability in a head-on crash and allows the wheelchair to clear a curb without catching vertical shaft 3. Allowing vertical shaft 3 to pivot or slide out of the way when not in use, is another alternative.

The locking assembly 1 can be operated either electrically or mechanically by conventional means known to one skilled in the art. If operated electrically, it is preferred that a mechanical locking release assembly 37 also be attached to the locking assembly to allow unlocking in case of an electrical failure.

In operation, support bracket 2 is fixed to wheelchair 4 by positioning bar 24 between runners 27 and then extending end members 25 and 26 about runners 27. End members are then fixed by bolt 38 positioned in openings 30 and 31 and by bolt 33 positioned in openings 32. The wheelchair is lifted or rolled into the vehicle and aligned so that vertical shaft 3 travels between tines 12 and 13 until it reaches vertex area 16. Lock 6 is then activated causing locking member 8 and 9 to lock in position about vertical shaft 3. The wheelchair can then be rotated in any position desired by the person sitting the wheelchair or by an attendant.

EXAMPLE

Sled impact tests were conducted by the University of Michigan Transportation Research Institute (UMTRI). The tests were conducted using the criteria of the Massachusetts Rehabilitation Commission (MRC), test WK 8601 and WK 8602.

Applicant's wheelchair anchoring system was dynamically tested for a simulated vehicle crash pulse of 30 mph and 20 g's deceleration. These impact conditions are considered to be an appropriate and reasonable test pulse for restraints in van-sized vehicles. The MRC tests also provide for shoulder and lap restraints for the test dummy.

Both the WK 8601 and WK 8602 test results indicated that applicant's wheelchair anchoring device is quite effective at securing the wheelchair in place.

There are of course other obvious embodiments not specifically described, such as a "Y" shaped bracket instead of an "H" shaped bracket, which are included within the scope of the invention as defined by the following claims.

I claim:

1. An apparatus for anchoring a wheelchair to the floor of a vehicle, comprising:

(a) an attaching assembly having:

(i) a support bracket connected to an underside of said wheelchair;

(ii) a vertical shaft perpendicularly attached to said support bracket and extending downward; and (b) a single locking assembly fixedly mounted at a predetermined position on the floor of said vehicle comprising a single locking means to receive and lock to said vertical shaft by means to allow rotation of said vertical shaft while locked by said single locking means, said locking means being attached to the inside of a housing fixedly mounted on the floor, said housing having a guide channel extending along and through its top surface to receive said vertical shaft and position it within said locking means.

2. An apparatus according to claim 1 wherein said vertical shaft is interiorly positioned with respect to the wheels of said wheelchair.

3. An apparatus according to claim 2 wherein said vertical shaft is contained within a cylinder defined by a first and second rear wheel of said wheelchair.

4. An apparatus according to claim 3 wherein said vertical shaft terminates to allow clearance between a lower end of said vertical shaft and the floor of said vehicle.

5. An apparatus according to claim 4 wherein said lower end of said vertical shaft is flanged to prevent disengagement from said locking means.

6. An apparatus according to claim 2 wherein said support bracket is aligned substantially parallel to the floor of said vehicle.

7. An apparatus according to claim 2 wherein said locking means automatically locks around said vertical shaft when said vertical shaft is urged against said locking means.

* * * * *